US006591903B2

(12) United States Patent
Ingle et al.

(10) Patent No.: US 6,591,903 B2
(45) Date of Patent: Jul. 15, 2003

(54) METHOD OF RECOVERY OF HYDROCARBONS FROM LOW PRESSURE FORMATIONS

(75) Inventors: Raymond L. Ingle, Houston, TX (US); Kenneth D. Pfau, Houston, TX (US)

(73) Assignee: EOG Resources Inc., Houston, TX (US)

( * ) Notice: Subject to any disclaimer, the term of this patent is extended or adjusted under 35 U.S.C. 154(b) by 71 days.

(21) Appl. No.: 10/010,248

(22) Filed: Dec. 6, 2001

(65) Prior Publication Data

US 2003/0106686 A1 Jun. 12, 2003

(51) Int. Cl.[7] ..... E21B 43/30

(52) U.S. Cl. ..... 166/50; 166/369; 175/61

(58) Field of Search ..... 166/50, 401, 268, 166/369, 370, 372, 68.5; 175/61, 62

(56) References Cited

U.S. PATENT DOCUMENTS

| | | | | |
|---|---|---|---|---|
| 3,934,649 | A | | 1/1976 | Pasini, III et al. |
| 4,089,374 | A | | 5/1978 | Terry |
| 4,221,433 | A | | 9/1980 | Jacoby |
| 4,257,650 | A | | 3/1981 | Allen |
| 4,299,295 | A | | 11/1981 | Gossard |
| 4,397,360 | A | | 8/1983 | Schmidt |
| 4,434,849 | A | * | 3/1984 | Allen ..... 166/272.3 |
| 4,544,037 | A | | 10/1985 | Terry |
| 4,605,076 | A | | 8/1986 | Goodhart |
| 4,611,855 | A | | 9/1986 | Richards |
| 4,646,836 | A | * | 3/1987 | Goodhart ..... 166/303 |
| 4,978,172 | A | | 12/1990 | Schwoebel et al. |
| 5,016,710 | A | | 5/1991 | Renard et al. |
| 5,074,360 | A | | 12/1991 | Guinn |
| 5,074,365 | A | | 12/1991 | Kuckes |
| 5,148,875 | A | | 9/1992 | Karlsson et al. |
| 5,217,076 | A | | 6/1993 | Masek |
| 5,246,273 | A | | 9/1993 | Rosar |
| 5,301,760 | A | | 4/1994 | Graham |
| 5,402,851 | A | | 4/1995 | Baiton |
| 5,411,104 | A | | 5/1995 | Stanley |
| 5,450,902 | A | | 9/1995 | Matthews |
| 5,462,116 | A | | 10/1995 | Carroll |
| 5,501,279 | A | | 3/1996 | Garg et al. |
| 5,615,739 | A | | 4/1997 | Dallas |
| 5,669,444 | A | | 9/1997 | Riese et al. |
| 5,690,390 | A | | 11/1997 | Bithell |
| 5,715,891 | A | * | 2/1998 | Graham ..... 166/313 |
| 5,720,356 | A | | 2/1998 | Gardes |
| 5,785,133 | A | | 7/1998 | Murray et al. |
| 5,868,202 | A | | 2/1999 | Hsu |
| 5,868,210 | A | | 2/1999 | Johnson et al. |
| 5,934,390 | A | | 8/1999 | Uthe |
| 6,280,000 | B1 | | 8/2001 | Zupanick |
| 6,425,448 | B1 | * | 7/2002 | Zupanick et al. ..... 175/61 |
| 6,478,085 | B2 | * | 11/2002 | Zupanick ..... 166/50 |
| 2001/0010432 | A1 | | 8/2001 | Zupanick |
| 2001/0015574 | A1 | | 8/2001 | Zupanick |

FOREIGN PATENT DOCUMENTS

| | | |
|---|---|---|
| WO | WO 94/21889 | 9/1994 |

* cited by examiner

*Primary Examiner*—Frank S. Tsay
(74) *Attorney, Agent, or Firm*—Fulbright & Jaworski L.L.P.

(57) ABSTRACT

The subject invention is directed to a method for the surface recovery of hydrocarbons from a subterranean reservoir. The reservoir can be a formation found in sandstone, carbonate, coal bed or other mineral deposit formations. The method includes drilling a well bore having a first substantially vertical portion and a first substantially horizontal portion, in which the first horizontal portion intersects the subterranean reservoir. A plurality of lateral well bores intersecting and extending from the first horizontal portion of the well bore are drilled. Thereafter, a drainage well bore is drilled below and substantially parallel to the first horizontal portion of the well bore, in which the drainage well bore intersects the first horizontal portion. The drainage well bore is configured to allow for the drainage of fluids from the plurality of lateral well bores and the first horizontal portion of the well bore, which allows for the recovery of hydrocarbons through the vertical portion of the well bore separate from the fluids.

32 Claims, 4 Drawing Sheets

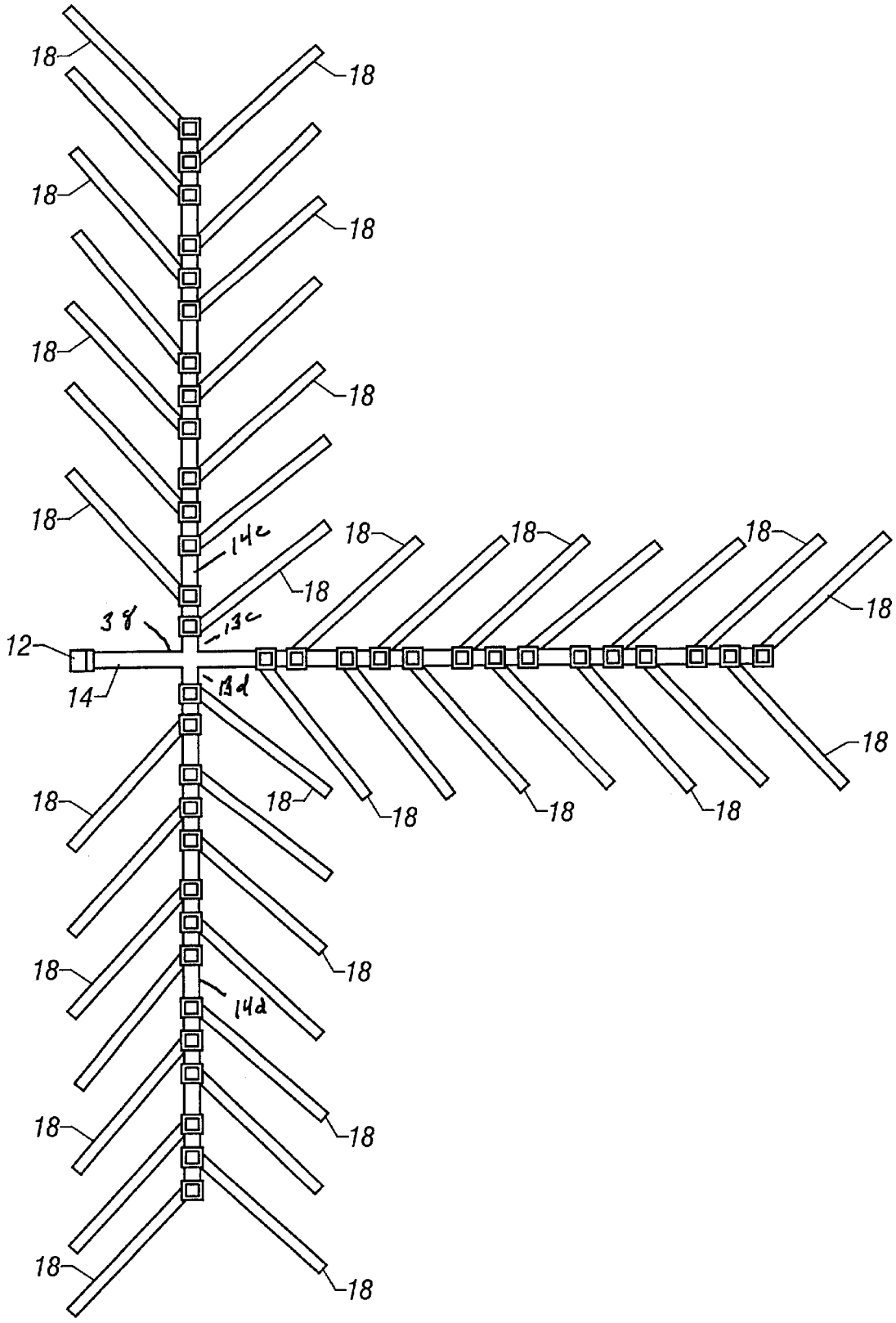
18
18
18

METHOD OF RECOVERY OF HYDROCARBONS FROM LOW PRESSURE FORMATIONS

FIELD OF THE INVENTION

The invention generally relates to a method of producing hydrocarbons and more particularly to a single well method for specifically directed penetrations of hydrocarbon bearing formations and the removal of production-inhibiting liquids from the hydrocarbon reservoir(s) in the formations.

BACKGROUND OF THE INVENTION

One of the most important and valuable resources removed from the earth are fossil fuels: such as coal, oil and gas. Since the early twentieth century, oil has become so important to the world economy that its continued supply has taken on strategic importance. To obtain fluid hydrocarbons such as oil and gas from below the earth's surface, boreholes or well bores are drilled from one or more surface locations into hydrocarbon-bearing subterranean geological strata or formations (also referred to in the industry as the reservoirs). The hydrocarbons are then pumped from the subterranean formations, through the well bores, to the surface.

A significant proportion of the current drilling activity in the United States and other areas of the world, involves drilling highly deviated and/or substantially horizontal well bores that extend laterally through a formation. Typically, in order to drill a horizontal well bore into a desired formation, the well bore is drilled from a surface location vertically into the earth for a certain depth. At a predetermined depth, the vertical well bore is deviated into a desired direction so as to reach the desired horizontal path through the formation, which is usually the target hydrocarbon bearing formation. The horizontal portion of the well bore is then drilled a desired length into the hydrocarbon-bearing producing formation.

Horizontally drilled wells have many advantages in conventional sandstone reservoirs because of the much-improved linear flow characteristics present in horizontal wells as opposed to the radial flow characteristics inherent in vertical wells. In many different kinds of formations horizontally drilled wells have also become quite popular in attempts to produce commercially viable wells. Early work with horizontal drilling focused on formations with naturally occurring fractures such as the Austin Chalk or Bakken Shale. More recently, horizontal drilling has been applied to many other formation types.

Additionally, as described in U.S. Pat. Nos. 5,868,210 and 5,785,133, it has become very common to drill multiple lateral (laterals) well bores off from a main horizontal well bore. Those skilled in hydrocarbon recovery operations have long recognized the benefits of drilling multiple laterals off a single horizontal borehole that extends up to the surface as this drainage pattern allows for more efficient recovery of hydrocarbons from each reservoir in a formation. The primary well bore and the multi-lateral well bores are generally drilled along predetermined well bore paths that follow the various levels of producing reservoirs in any one formation.

Conventional hydrocarbon production systems leave much to be desired for a variety of reasons. One reason relates to the fact that in many gas producing formations, the targeted hydrocarbon-producing reservoir is sensitive to the presence of naturally occurring formation liquids, primarily oil and water. Methane producing subterranean formations often contain significant quantities of water, which results in high hydrostatic pressures. If the oil and water can be successfully removed from the producing reservoirs, the volume of natural gas or methane that can be produced is significantly enhanced. Typically, to provide a satisfactory methane recovery rate from a producing well bore, the region of the formation surrounding the well bore must be dewatered or drained in order to lower the hydrostatic pressure to a point where sufficient quantities of hydrocarbon gas and liquids will enter the producing well bore.

This liquid removal is achieved by reducing a producing well bore's hydrostatic pressure in order to establish a differential pressure between the formation's pressure and the pressure of the well bore. Once a differential pressure is established, fluid will flow from the formation into the producing well bore. The fluid in the well bore is then pumped to the surface by mechanical pumps. As the fluid in the formation is removed and the pressure in the formation is thus reduced, the methane recovery rate will increase. The removal of methane and other fluids from a recovery well that is controlled by the lowering of the pressure within the formation is generally referred to as a "primary pressure depletion methane recovery" system. Most horizontal drilling methods utilize this system of recovery.

However, pressure depletion methane recovery systems present other problems. Because of the manner in which most of the current horizontal well bore configurations are drilled, mechanical pumps are typically located in the vertical or near-vertical portion of the well bore at a substantial vertical distance above the horizontal portion of the well bore. This leads to inefficiencies in pumping the liquids from the depths of the well bore.

The method of the subject invention eliminates and/or reduces the disadvantages and problems associated with previous systems and methods. In particular, the present invention allows for a single well bore to effectively access entrained hydrocarbons and to separate down-hole non-productive fluids (water and liquid hydrocarbons) from the vaporous natural gas. This allows for a reduction in surface separation facilities. The inventive method lowers the cost of hydrocarbon production, allows for more efficient production and causes fewer disturbances to surrounding natural habitat. The use of a single well bore for the separate removal of both water and hydrocarbons allows for fewer wells to be drilled in any one formation, which minimizes the impact to the surface above the formation. The inventive method can be used for any normal or low-pressure formation including degasifying subsurface coal seams prior to mine excavation, which provides for safer coal mining conditions. It also allows for the extension of the producing life of conventional low-pressure hydrocarbon bearing formations beyond their current economic limit.

SUMMARY OF THE INVENTION

The subject invention is directed to a method for the surface recovery of hydrocarbons from a subterranean reservoir. The reservoir can be a formation found in sandstone, carbonate, coal bed or other mineral deposit formations. The method includes drilling a well bore having a first substantially vertical portion and a first substantially horizontal portion, in which the first horizontal portion intersects the subterranean reservoir. A plurality of lateral well bores intersecting and extending from the first horizontal portion of the well bore are drilled. Thereafter, a drainage well bore is drilled below and substantially parallel to the first horizontal portion of the well bore, in which the drainage well bore intersects the first horizontal portion. The drainage well bore is configured to allow for the drainage of fluids from the plurality of lateral well bores and the first horizontal portion of the well bore, which allows for the recovery of hydrocarbons through the vertical portion of the well bore separate from the fluids.

In one embodiment on the invention, the drainage well bore extends from a section of the first substantially vertical portion of the well bore at a position below the first horizontal portion of the well bore. The drainage well bore slopes downward in a first direction and then inclines upward in a second direction to intersect the first horizontal portion of the well bore. The drainage well bore is configured to allow for the drainage of fluids from the plurality of lateral well bores into the first horizontal portion of the well bore, into the drainage well bore and into the section of the vertical portion of the well bore.

In a second embodiment of the invention, the drainage well bore extends from the first horizontal portion of the well bore, at a position above a first of the plurality of lateral well bores. The drainage well bore slopes downward in a first direction and then extends outward in a second direction substantially parallel to the first horizontal portion of the well bore. The drainage well bore is configured to allow for the drainage of fluids from the plurality of lateral well bores into the first horizontal portion of the well bore, and into the drainage well bore.

In a further embodiment, a section of the vertical portion of the well bore extends a predetermined distance below the first horizontal portion of the well bore, the vertical section having a first and second side, the drainage well bore extending in a loop that originates from the first side of the vertical section, the loop thereafter intersecting the vertical section and exiting on the second side of the vertical section, the loop sloping in a first downward direction below the position of the first horizontal portion of the well bore and then inclining upward in a second direction to intersect the first horizontal portion of the well bore, the drainage, well bore being configured to allow for the drainage of fluids from the plurality of lateral well bores into the first horizontal portion of the well bore, into the drainage well bore and into the vertical section of the well bore, the lower portion of which is the last drilled.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which:

FIG. 7 is a schematic top view showing the formation of multiple drainage patterns in an alternate embodiment of the subject invention.

DETAILED DESCRIPTION OF THE INVENTION

Figure 1:
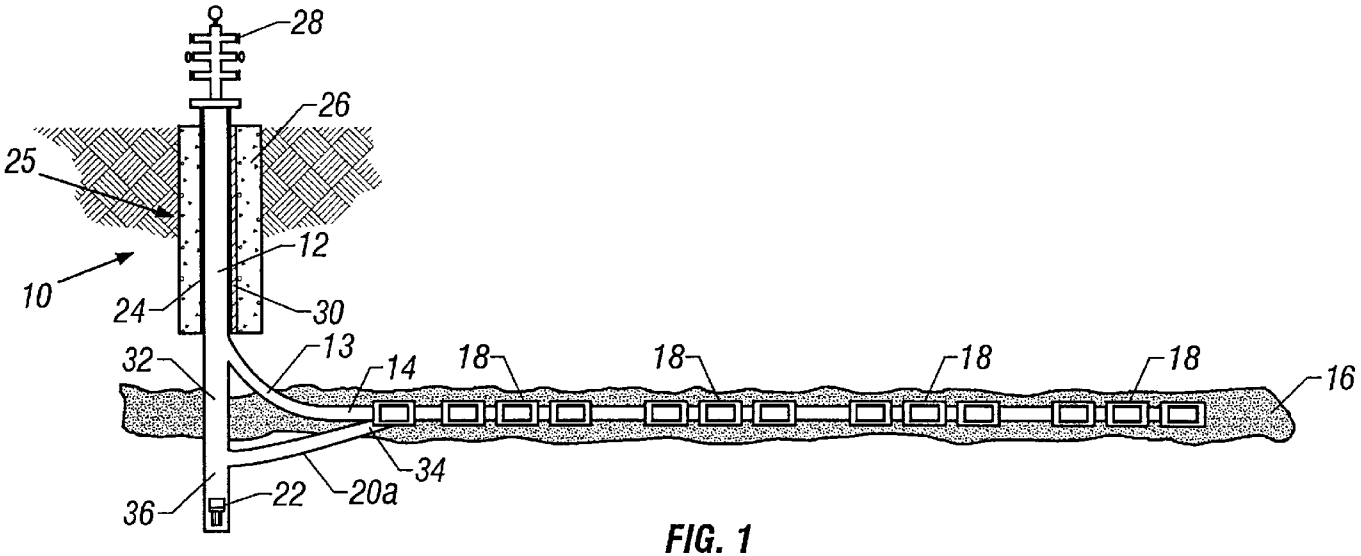
FIG. 1 is a schematic cross-sectional view showing a method of drilling and completing an access well bore of the subject invention.

The present invention is directed to a method for surface hydrocarbon recovery from a subterranean reservoir that can be used in the development of any underground hydrocarbon-bearing formations including sandstone, carbonate, coal beds or mineral deposits. The removal rate of natural gas from a subterranean hydrocarbon-bearing formation can be controlled by the configuration and the manner of construction of a borehole. For the purpose of illustration, and not by way of limitation, the method of the present invention will be described in relation to recovery of hydrocarbons from low-pressure deposits, including conventional hydrocarbon-bearing formations such as coal deposits and sandstone and carbonate reservoirs.

The subject invention is directed to a substantially subterranean hydrocarbon producing configuration that includes a single well bore 10 having a vertical portion 12 drilled in a predominately-vertical direction to within a few hundred feet of a producing reservoir(s) 16. A first main horizontal portion 14 of the well bore 10 extends from the vertical portion 12 a significant length (often greater than 2,000 feet) into the producing reservoir 16. The main horizontal portion 14 of the well bore is drilled up-dip (an incline toward the surface) and is provided with a plurality of secondary lateral well bores 18 positioned in the same horizontal plane as the horizontal portion 14.

An important element in hydrocarbon production is the minimization of the volume and hydrostatic pressure of the liquids residing in any target formation. The process of removing the liquids from under-pressurized formations is sometimes referred to as "de-watering". In the inventive method a second intersecting horizontal "dewatering" or drainage well bore 20 is positioned a predetermined distance below and substantially parallel to the main horizontal well bore 14 for the separation and removal of non-productive fluids (water and liquid hydrocarbons) from the main horizontal portion 14 of the well bore 10. A mechanical pump 22 is positioned below or at the level of the drainage well bore 20 in order to pump the non-productive fluids out of the producing well bore 10.

The inventive method provides a drilling configuration that enables hydrocarbons to be produced from a formation at a lower bottom hole pressure than would be possible if the pump 22 were positioned near the junction of the vertical and horizontal portions 12, 14 of the well bore 10. The inventive method also contemplates both multiple laterals and main horizontal well bores producing into a single vertical well bore as this configuration will maximize the efficiency of the producing well bore and surface equipment associated with the vertical portion of the well. Examples of the various drilling configurations of the subject invention are shown in the FIGS. 1–6.

When drilling well bores for hydrocarbon production, operators typically utilize a drill string that includes a drilling device and a number of measurement-while-drilling ("MWD") devices as are known to those skilled in the art. The MWD devices are tools and/or instruments that are placed down into the well bore in order to provide well bore information at the surface. In typical drilling operations, a borehole is drilled a predetermined distance and a casing 24 is installed in the borehole. Cement 26 surrounds the casing 24 in order to keep it in place. These procedures are well known to those skilled in the art of drilling. The drilling device, with the aid of drilling fluids, is used to disintegrate the subsurface formations and the MWD devices are used to determine the properties of the formations and the downhole drilling conditions. Portions of the drilling device and associated equipment are located at the surface of the well bore and is collectively called the wellhead assembly 28. Control of the drilling process is also maintained through the use of MWD devices that measure the returned fluids and the type, consistency and volume of drilling cuttings. Through the collective use of the information provided by these MWD devices and other measurement devices and instruments, the path of the horizontal portion of the well bore is adjusted in order to maintain optimum location within the target reservoir(s). Operators utilize the information received from the MWD devices to adjust the drilling direction and other drilling parameters as is known to one skilled in the art.

When hydrocarbon production is being carried out in formations that have a relatively low hydrostatic pressure, conventional drilling systems typically produce a hydrostatic pressure greater than the hydrostatic pressure of the target reservoir. This higher pressure in the drilling system results in a loss of fluid and cuttings into the target reservoir. The loss of fluids due to this "over-balanced" pressure condition are not only costly, but can also cause the fluid and cuttings to plug the target reservoir, which results in a reduction or even elimination of the formation's ability to produce hydrocarbons.

To minimize these pressure problems, compressed air is utilized in several different ways to reduce the density of the returning fluids. In one method, which is often referred to as "aeration," the compressed air is injected into the drill string simultaneously with the drilling fluids. In a second method, often referred to as "jetting," the compressed air is injected into a second small diameter ("parasite") casing 30, installed outside of and parallel to the main casing 24, and it enters the flow stream of the returning drilling fluids near the base of the vertical portion 12 of the well bore 10. In the subject invention, both methods reduce the hydrostatic pressure in the formation and aid in the removal of cuttings and other debris from the well bore. In certain hydrocarbon production systems, in addition to the injecting of compressed air and drilling fluids, it is also common to inject chemicals known as "foamers" and "surfactants" which aid in the efficient mixing of air and fluid. The addition of these chemicals results in an even more effective removal of drilling contaminates. The method of the subject invention includes the standard drilling operations discussed above.

In the method of the subject invention, a substantially vertical well bore 12 is drilled to a point near the depth of the target hydrocarbon-bearing formation or reservoir 16. A casing 24, as is known to one skilled in the art, is installed in the upper portion 25 of the well bore in to order to isolate this portion of the penetrated formation (FIGS. 1–3, 6). Cement 26 surrounds the casing 24. For example, in a coal containing formation, the installed casing 24 would end just above the coal reservoir. If the formation has a very low reservoir pressure, a second small diameter ("parasite") casing 30, preferably having an outside diameter of about 1 inch can be installed outside of and parallel to the main casing 24 (FIGS. 1–3, 6).

The vertical portion 12 of the well bore 10 is then drilled to a deeper depth and articulated through a radius section 13 to achieve a substantially horizontal portion 14 having a predominately-horizontal path in a direction that is upward (up-dip) to the naturally occurring dip of the target reservoir 16. The horizontal portion 14 is drilled up-dip in order to allow the fluid in the reservoir 16 to drain down the horizontal portion 14 of the well bore 10 towards the vertical portion 12. The drilling is accomplished using a bit, drill string and downhole motor as is known to one skilled in the art. During the drilling process, drilling fluids are used for cleaning the drilled cuttings from the well bore. These fluids are predominately water-based and are pumped down the drill string through the bit, where they collect the cuttings and then carry them up to the surface.

Figure 4:
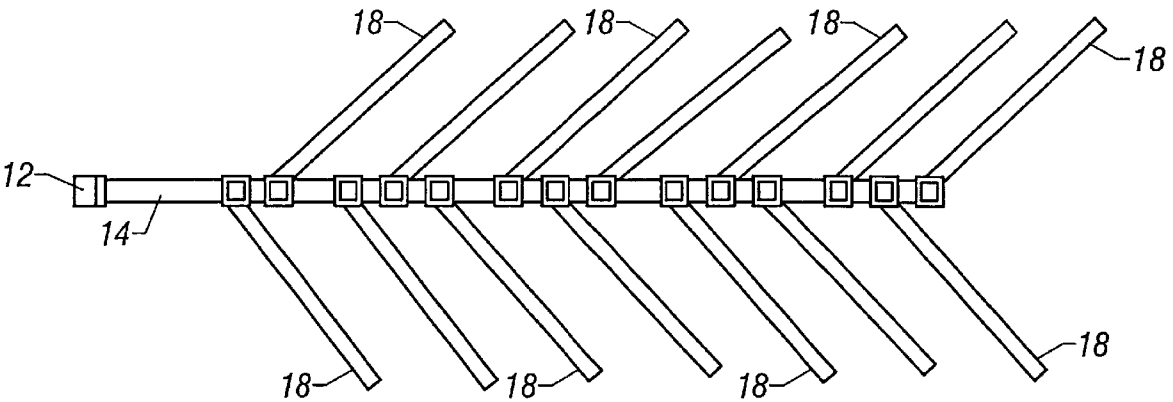
FIG. 4 is a schematic top view showing the formation of multiple lateral well bores extending from the horizontal portion of the access well bores of FIGS. 1, 2 and 6.

The drilling of the horizontal portion 14 of well bore 10 is continued to a point near the end of the target reservoir(s) 16 or the designated drainage acreage, which can often result in a length of 1,000 to 3,000 or more feet. Thereafter, a plurality of secondary lateral well bores (laterals) 18 are drilled, extending out from the main horizontal portion 14 of the well bore 10 and in the same predominately horizontal plane as the horizontal portion 14. Likewise, the plurality of laterals 18 are drilled in a direction that is upward (up-dip) to the naturally occurring dip of the target reservoir 16 in order to allow the fluid in the reservoir 16 to drain down the laterals 18 into the horizontal portion 14 of the well bore 10. Each of the plurality of laterals 18 has a spacing and length adequate to deplete the formation. Preferably, the laterals 18 are approximately equally spaced and extend in substantially parallel alignment on opposite sides of the main horizontal portion 14 of the well bore 10. This drainage pattern is well known to one skilled in the art as described in U.S. Pat. No. 5,785,133 and fully incorporated herein by reference. The number of laterals 18 used and the precise spacing of each of the secondary laterals 18 can be adjusted to fit the size and geometry of the drainage reservoir 16 within the formation. FIG. 4 illustrates a typical drainage pattern that can be achieved with the use of a plurality of laterals 18 extending out from the main horizontal portion 14 of the well bore 10.

Figure 2:
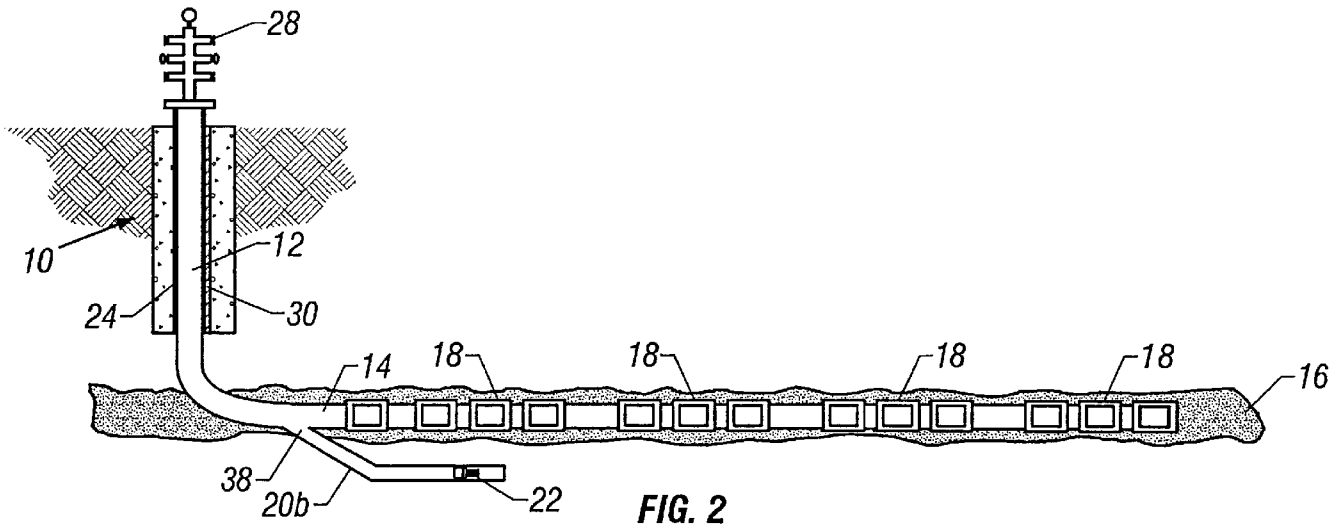
FIG. 2 is a schematic cross-sectional view showing an alternate embodiment of the method of drilling and completing an access well bore of the subject invention.
Figure 3:
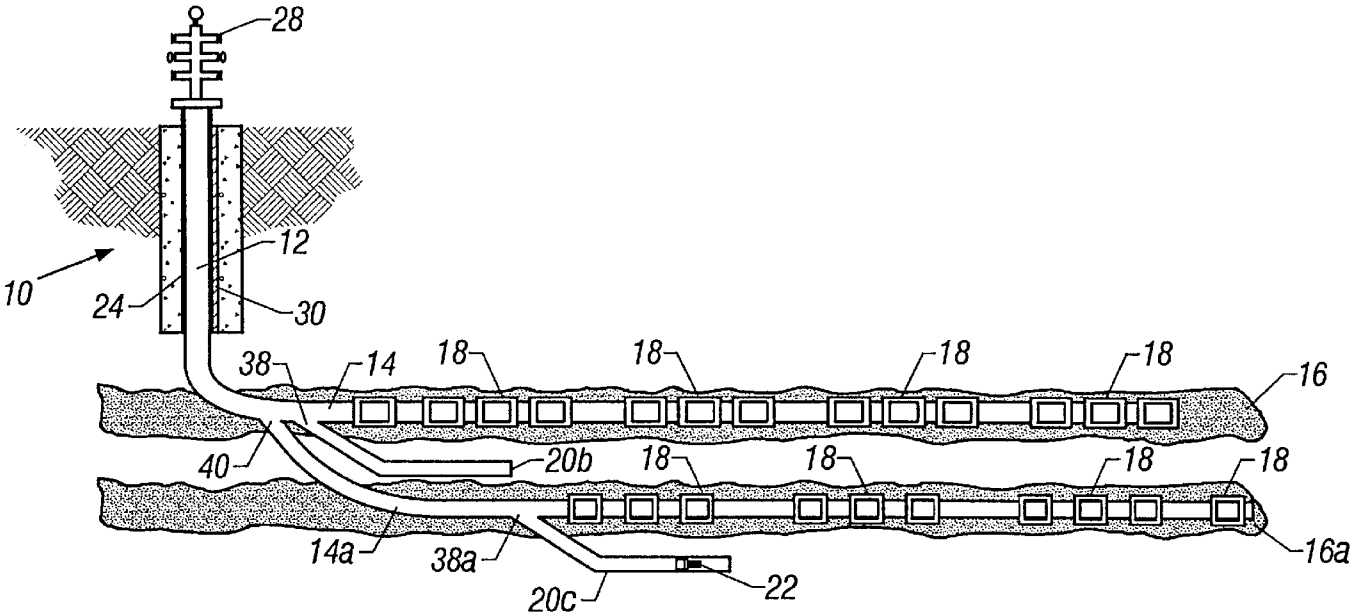
FIG. 3 is a schematic cross-sectional view showing an alternate embodiment of the method of FIG. 2.

The inventive method provides for the drilling of another short horizontal well bore immediately below the radius of the main horizontal portion 14 of the well bore 10 in order to provide for the removal of the liquids from the main horizontal portion 14 of the well bore 10 (FIGS. 1–3). This short well bore is called a dewatering or drainage well bore 20 and is positioned so as to be below and predominately parallel to the main horizontal well bore 14. The drainage well bore 20 intersects the main horizontal well bore 14 and preferably continues for a distance of several hundred feet, for example 150 to 500 hundred feet. The drainage well bore 20 allows for the accumulation of fluids that drain into the main horizontal portion 14 of the well bore 10 from the plurality of secondary laterals 18. A pump 22 is used to remove these fluids from the drainage well bore 20. The pump 22 preferably can be a sub-surface, electric, bottom-driven Progressing Cavity Pump. Preferably, the pump 22 is inserted into or adjacent to the drainage well bore 20 and is connected to a conduit (not shown), such as a tubular string or the like, that is installed in the well casing as is known to those skilled in the art. Once in place, the pump 22 gathers the fluids that accumulate in the drainage well bore 20 and pumps them to the surface through the tubular string.

In one embodiment of the subject invention, as shown in FIG. 1, the vertical portion 12 of the well bore 10 extends a distance below the main horizontal portion 14 of the well bore 10, creating a vertical section 32. The drainage well bore 20*a* is drilled from this vertical section 32, a predetermined distance below the main horizontal well bore 14. The drainage well bore 20 initially slopes down in a first direction and then inclines upward in a second direction to intersect the main horizontal well bore 14, preferably at a position 34 in front of the first of the plurality of laterals 18. The distance of both the downslope and the incline will depend upon the conditions of the formation. In this embodiment, the pump 22, is preferably installed in a lower section 36 of the vertical section 32 that extends a short distance below the drainage well bore 20*a*. The fluids drain from the plurality of laterals 18 into the main horizontal portion 14 of the well bore 10, into the drainage well bore 20*a* and then into the lower section 36 of the vertical portion 32, where they are thereafter pumped to the surface through the tubular string (not shown).

In a second embodiment, as shown in FIG. 2, the drainage well bore 20*b* is drilled directly from the main horizontal well bore 14, originating at a position 38 in front of the first of the plurality of secondary laterals 18. In this embodiment, the drainage well bore 20*b* initially slopes downward a short distance, usually no more than 100 feet, and then runs predominately parallel to the main horizontal well bore 14 for a length of about several hundred feet. The fluids flow into the drainage well bore 20*b* from the main horizontal portion 14 of the well bore 10. A pump 22 is preferably positioned a short distance into the drainage well bore 20*b* and pumps the accumulated fluids to the surface through the tubular string (not shown).

Figure 5:
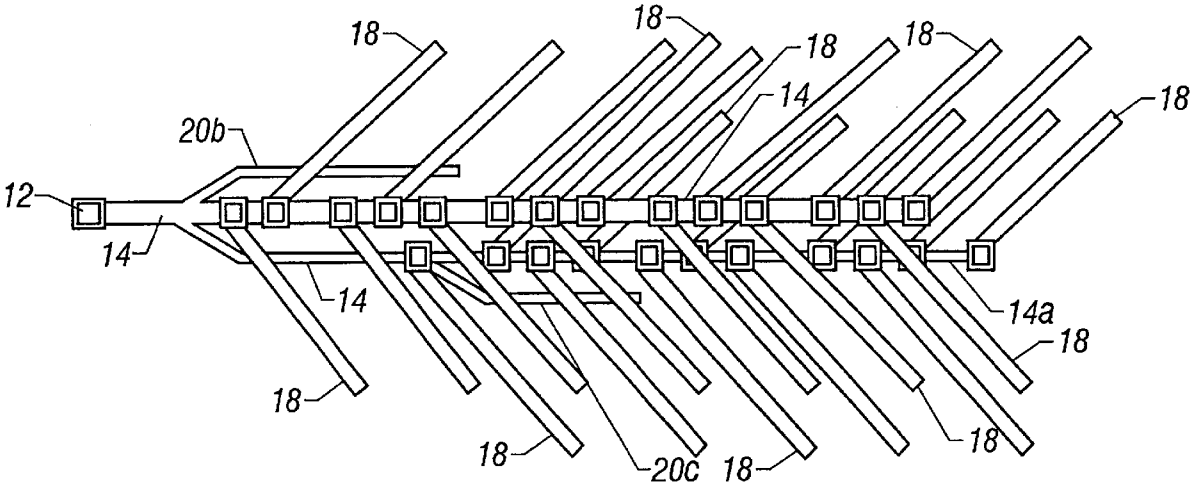
FIG. 5 is a schematic top view showing the formation of multiple lateral well bores extending from the access well bores of FIG. 3.

In some formations where the target reservoirs 16 are in adjacent or proximate parallel horizontal ("stacked") layers, it may be desirable to have more than one main horizontal well bore. In this situation, a second main horizontal well bore 14*a* can be drilled off from the first main horizontal well bore 14 as shown in FIG. 3. The second main horizontal well bore 14*a* intersects the first horizontal portion 14 at a position 40 in front of its drainage well bore 20*a*. The second horizontal well bore 14*a* slopes downward in a first direction intersecting a second target reservoir 16*a* and then extends outward in a second substantially horizontal direction into the second reservoir 16*a*. As in the prior embodiments, the second main horizontal well bore 14*a* includes a plurality of secondary lateral well bores (laterals) 18 extending out from the second main horizontal well bore 14*a*. Each of the plurality of laterals 18 has a spacing and length adequate to drain the formation. In this embodiment, the second drainage well bore 20*c* is drilled directly from the second main horizontal well bore 14*a*, originating at a position 38*a* in front of the first of the plurality of secondary laterals 18. The drainage well bore 20*c* initially slopes downward a short distance, usually no more than one hundred feet, and then runs parallel to the second main horizontal well bore 14*a* for a length of about several hundred feet. The fluids flow into the drainage well bore 20*c* from both the first and second main horizontal well bores 14, 14*a*. A pump 22 is positioned a short distance into the drainage well bore 20*c* and pumps the accumulated fluids to the surface through-the tubular string (not shown). In this situation, only one pump 22, placed in the drainage well bore 20*c* is necessary. FIG. 5 illustrates the drainage patterns that can be achieved with the use of a plurality of laterals 18 extending out from each of the first and second main horizontal well bores 14, 14*a*.

Figure 6:
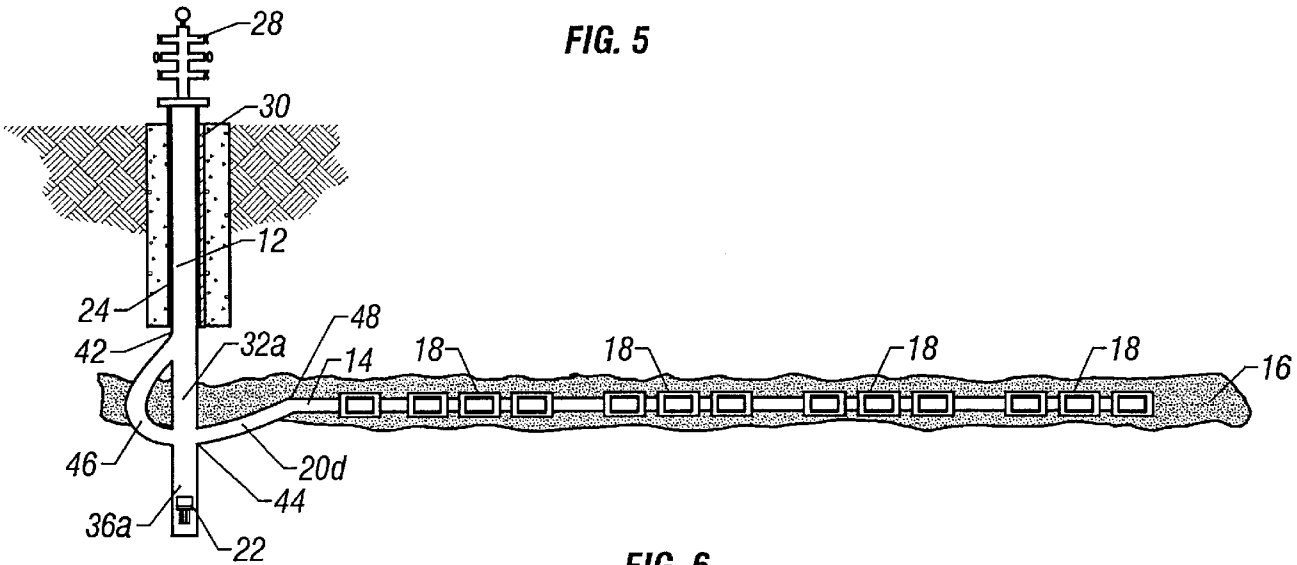
FIG. 6 is a schematic cross-sectional view showing another alternate embodiment of the method of drilling and completing an access well bore of the subject invention.

In a further embodiment of the subject invention, an extension of the vertical portion 32 of the well bore 10 can function as a portion of a drainage well bore 20*d*. As shown in FIG. 6, the horizontal portion 14 is first extended from the vertical portion 12 of the well bore 10. In this embodiment, the vertical section 32 has a first and second side 42, 44 respectively. The drainage well bore 20*d* extends from the first side 42 of the vertical section 32 and forms a loop 46 that extends through the vertical section 32 and exits on the second side 44 of the vertical section 32. The loop 46 slopes in a first downward direction below the position of the main horizontal portion 14 of the well bore 10 and then inclines upward in a second direction to the starting point 38 of the main horizontal portion 14 of the well bore 10. The loop 46 is formed by using an approximately 30° turn per 100 ft. of well bore. Once the main horizontal portion 14 of the well bore 10 and the plurality of laterals 18 are drilled, the vertical section 32 is further extended a distance of approximately one hundred feet below the main horizontal portion 14 of the well bore 10 to create a lower vertical section 32*a*. The main horizontal well bore 14, as described above, is provided with a plurality of secondary lateral well bores 18 positioned in the same horizontal plane (FIG. 4). In this embodiment, a pump 22 can be installed in the lower end 36*a* of the vertical section 32*a* of the well bore 10 that extends a distance below the main horizontal well bore 14. The fluids will drain from the main horizontal well bore 14, through the looped drainage well bore 20*d* and into the lower end 36*a* of the vertical section 32*a*. The fluids are then pumped to the surface through the tubular string (not shown).

The subject invention also contemplates the drilling of multiple drainage patterns in the same horizontal plane but in a different quadrant of the formation as illustrated in FIG. 7. In this embodiment for example, a second horizontal portion 14*c* can articulate from the main horizontal portion 14, preferably at point 38 as shown in FIG. 2, through an 80 to 100° radius 13*c* to the left of the main horizontal portion 14 into a substantially horizontal position. The second horizontal portion 14*c* would also include a plurality of lateral well bores 18 as described in the other embodiments. Likewise, a third horizontal portion 14*d* can articulate from the main horizontal portion 14, preferably at the same point 38, through an 80 to 100° radius 13*d* to the right of the main horizontal portion 14 into a substantially horizontal position. The third horizontal portion 14*d* would also include a plurality of lateral well bores 18 as described in the other embodiments. Thus, the second and third horizontal portions 14*c* and 14*d* could be at approximately a 180° degree angle in relation to each other. If for example, the embodiment of FIG. 2 was used, the drainage well bore 20*b* could be utilized for the second and third horizontal portions 14*c* and 14*d* or separate drainage well bores could be drilled for each of the second and third horizontal portions 14*c* and 14*d*.

In all of the above described embodiments, the gas in the target reservoir(s) is liberated by the removal of the fluid through the drainage well bores and the produced gas flows into the vertical portion of the well bore, through the casing and up to the surface where it is transported from the producing well.

As described above, the present invention provides an access well bore formed substantially in a non-producing formation which accesses one or more hydrocarbon-bearing formations or reservoirs via multiple lateral well bore patterns formed substantially in the producing formation. The access well bore includes a drainage well bore for the efficient removal of non-producing fluids from the formation. This process eliminates and/or reduces the disadvantages and problems associated with previous systems and methods. In particular, the present invention allows for a single well bore to effectively access entrained hydrocarbons, separate down-hole non-productive fluids (water and liquid hydrocarbons) from the vaporous natural gas, reducing the need for surface separation equipment. This process allows for less surface separation facilities to be installed. This not only lowers the cost, makes the operation more efficient, but also causes fewer disturbances to surrounding natural habitat. The use of a single well bore also allows for fewer wells to be drilled, which also minimizes the impact to the surface. This method may be used for any normal or low-pressure reservoir including degasifying subsurface coal seams prior to mine excavation, which increases the safety of miners. It also allows for the producing life of conventional low-pressure hydrocarbon bearing reservoirs to be extended beyond their current economic limit. Previously abandoned projects will be able to be rejuvenated, which will allow lost hydrocarbon reserves to be recovered.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for the recovery of hydrocarbons from a subterranean reservoir comprising:

drilling a well bore having a first substantially vertical portion and a first substantially horizontal portion, the first horizontal portion intersecting the subterranean reservoir;

drilling a plurality of lateral well bores intersecting and extending from the first horizontal portion of the well bore;

drilling a drainage well bore below and substantially parallel to the first horizontal portion of the well bore, the drainage well bore intersecting at least the first horizontal portion;

wherein the drainage well bore is configured to allow for the drainage of fluids from the plurality of lateral well bores and the first horizontal portion of the well bore, allowing for the recovery of hydrocarbons through the vertical portion of the well bore separate from the fluids.

2. The method of claim 1, wherein the subterranean reservoir is in a formation selected from a group consisting of sandstone, carbonate, coal bed and mineral deposit formations.

3. The method of claim 1, wherein a mechanical pump is positioned below or at a level of a portion of the drainage well bore for pumping the fluids from the drainage well bore to the surface.

4. The method of claim 3, wherein the pump is connected to a conduit for transporting the fluids from the drainage well bore to the surface.

5. The method of claim 1, further including installing a main casing in an upper portion of the first substantially vertical portion of the well bore.

6. The method of claim 5, further including injecting compressed air into a separate small diameter casing positioned outside of and parallel to the main casing, the compressed air entering a flow stream of returning drilling fluids.

7. The method of claim 1, wherein the first substantially horizontal portion is drilled a length of about 1000 to 3000 feet into the subterranean reservoir.

8. The method of claim 1, wherein the first substantially horizontal portion of the well bore is drilled in a direction that is up-dip to a naturally occurring dip of the subterranean reservoir.

9. The method of claim 8, wherein the plurality of lateral well bores are drilled in a direction that is up-dip to a naturally occurring dip of the subterranean reservoir.

10. The method of claim 1, wherein the plurality of lateral well bores intersect and extend from the first horizontal portion of the well bore in a same predominately horizontal plane as the first horizontal portion.

11. The method of claim 10, wherein each of the plurality of lateral well bores has a spacing and length configured to deplete hydrocarbons from the reservoir.

12. The method of claim 11, wherein each of the plurality of lateral well bores are approximately equally spaced and extend in substantially parallel alignment on opposite sides of first horizontal portion of the well bore.

13. The method of claim 1, wherein the drainage well bore has a distance of about 150 to 500 hundred feet.

14. The method of claim 1, wherein the drainage well bore extends from a section of the first substantially vertical portion of the well bore at a position below the first horizontal portion of the well bore, the drainage well bore sloping downward in a first direction and then inclining upward in a second direction to intersect the first horizontal portion of the well bore, the drainage well bore being configured to allow for the drainage of fluids from the plurality of lateral well bores into the first horizontal portion of the well bore, into the drainage well bore and into the section of the vertical portion of the well bore.

15. The method of claim 14, further including placing a pump in the section of the vertical portion of the well bore that extends a distance below the drainage well bore for pumping fluids from the drainage well bore to the surface.

16. The method if claim 1, wherein the drainage well bore extends from the first horizontal portion of the well bore, at a position in front of a first of the plurality of lateral well bores, the drainage well bore sloping downward in a first direction and then extending outward in a second direction substantially parallel to the first horizontal portion of the well bore, the drainage well bore being configured to allow for the drainage of fluids from the plurality of lateral well bores into the first horizontal portion of the well bore, and into the drainage well bore.

17. The method of claim 16, further including placing a pump in a section of the drainage well bore for pumping fluids from the drainage well bore to the surface.

18. The method of claim 1, further including:

drilling a second horizontal well bore below the first horizontal portion of the well bore, the second horizontal well bore intersecting the first horizontal portion at a position in front of the drainage well bore, the second horizontal well bore sloping downward in a first direction intersecting a second subterranean reservoir and then extending outward in a second substantially horizontal direction into the second subterranean reservoir drilling a plurality of lateral well bores intersection and extending from the second horizontal well bore;

drilling a drainage well bore below and substantially parallel to the second horizontal well bore, the drainage well bore intersecting the second horizontal well bore;

wherein the drainage well bore is configured to allow for the drainage of fluids from the plurality of lateral well bores and the first and second horizontal well bores.

19. The method of claim 18, wherein the second horizontal well bore is drilled in a direction that is up-dip to a naturally occurring dip of the subterranean reservoir.

20. The method of claim 19, wherein the plurality of lateral well bores are drilled in a direction that is up-dip to a naturally occurring dip of the subterranean reservoir.

21. The method of claim 18, wherein the drainage well bore extends from the second horizontal well bore, at a position in front of a first of the plurality of lateral well bores, the drainage well bore sloping downward in a first direction and then extending outward in a second direction substantially parallel to the second horizontal well bore, the drainage well bore being configured to allow for the drainage of fluids from the plurality of lateral well bores into the second horizontal well bore, and into the drainage well bore.

22. The method of claim 21, further including placing a pump in a section of the drainage well bore for pumping fluids from the drainage well bore to the surface.

23. The method of claim 1, wherein a section of the vertical portion of the well bore extends a predetermined distance below the first horizontal portion of the well bore, the vertical section having a first and second side, the drainage well bore extending in a loop that originates from the first side of the vertical section, the loop thereafter intersecting the vertical section and exiting on the second side of the vertical section, the loop sloping in a first downward direction below the position of the first horizontal portion of the well bore and then inclining upward in a second direction to intersect the first horizontal portion of the well bore, the drainage well bore being configured to allow for the drainage of fluids from the plurality of lateral well bores into the first horizontal portion of the well bore, into the drainage well bore and into the vertical section of the well bore.

24. The method of claim 23, further including placing a pump in the vertical section of the well bore that extends a distance below the drainage well bore for pumping fluids from the drainage well bore to the surface.

25. The method if claim 1, further including producing hydrocarbons from the subterranean reservoir separate from the fluids in the reservoir.

26. The method of claim 1, further including the drilling of multiple horizontal well bores off of the first horizontal portion of the well bore, the multiple horizontal well bores being positioned in the same horizontal plane as the first horizontal portion of the well bore.

27. The method of claim 26, wherein each of the multiple horizontal well bores includes a plurality of lateral well bores intersecting and extending from each of the multiple horizontal well bore.

28. The method of claim 26, wherein one of the multiple horizontal well bores articulates from the first horizontal portion through an 80 to 100° radius to the left of the first horizontal portion into a substantially horizontal position.

29. The method of claim 26, wherein one of the multiple horizontal well bores articulates from the first horizontal portion through an 80 to 100° radius to the right of the first horizontal portion into a substantially horizontal position.

30. A method for the recovery of hydrocarbons from a subterranean reservoir comprising:

drilling a well bore having a first substantially vertical portion and a first substantially horizontal portion, the first horizontal portion intersecting the subterranean reservoir;

drilling a plurality of lateral well bores intersecting and extending from the first horizontal portion of the well bore;

drilling a drainage well bore below and substantially parallel to the first horizontal portion of the well bore, the drainage well bore intersecting the first horizontal portion, the drainage well bore extending from a section of the first substantially vertical portion of the well bore at a position below the first horizontal portion of the well bore, the drainage well bore sloping downward in a first direction and then inclining upward in a second direction to intersect the first horizontal portion of the well bore;

wherein the drainage well bore is configured to allow for the drainage of fluids from the plurality of lateral well bores and the first horizontal portion of the well bore, allowing for the recovery of hydrocarbons through the vertical portion of the well bore separate from the fluids.

31. A method for the recovery of hydrocarbons from a subterranean reservoir comprising:

drilling a well bore having a first substantially vertical portion and a first substantially horizontal portion, the first horizontal portion intersecting the subterranean reservoir;

drilling a plurality of lateral well bores intersecting and extending from the first horizontal portion of the well bore;

drilling a drainage well bore below and substantially parallel to the first horizontal portion of the well bore, the drainage well bore intersecting the first horizontal portion, the drainage well bore extending from the first horizontal portion of the well bore, at a position in front of a first of the plurality of lateral well bores, the drainage well bore sloping downward in a first direction and then extending outward in a second direction substantially parallel to the first horizontal portion of the well bore;

wherein the drainage well bore is configured to allow for the drainage of fluids from the plurality of lateral well bores and the first horizontal portion of the well bore, allowing for the recovery of hydrocarbons through the vertical portion of the well bore separate from the fluids.

32. A method for the recovery of hydrocarbons from a subterranean reservoir comprising:

drilling a well bore having a first substantially vertical portion and a first substantially horizontal portion, the first horizontal portion intersecting the subterranean reservoir;

drilling a plurality of lateral well bores intersecting and extending from the first horizontal portion of the well bore;

drilling the vertical portion of the well bore to extend a predetermined distance below the first horizontal portion of the well bore, the vertical section having a first and second side;

drilling a drainage well bore below and substantially parallel to the first horizontal portion of the well bore, the drainage well bore extending in a loop that originates from the first side of the vertical section, the loop thereafter intersecting the vertical section and exiting on the second side of the vertical section, the loop sloping in a first downward direction below the position of the first horizontal portion of the well bore and then inclining upward in a second direction to intersect the first horizontal portion of the well bore;

wherein the drainage well bore is configured to allow for the drainage of fluids from the plurality of lateral well bores and the first horizontal portion of the well bore, allowing for the recovery of hydrocarbons through the vertical portion of the well bore separate from the fluids.

* * * * *